US007699759B1

(12) United States Patent
Page

(10) Patent No.: US 7,699,759 B1
(45) Date of Patent: Apr. 20, 2010

(54) AQUATIC RESISTANCE ASSEMBLY

(76) Inventor: Douglas M. Page, 3731 SW. Wildcat Run Rd., Arcadia, FL (US) 34266

( * ) Notice: Subject to any disclaimer, the term of this patent is extended or adjusted under 35 U.S.C. 154(b) by 0 days.

(21) Appl. No.: 12/477,843

(22) Filed: Jun. 3, 2009

(51) Int. Cl.
*A63B 21/06* (2006.01)
*A63B 21/008* (2006.01)

(52) U.S. Cl. ..... 482/93; 482/111

(58) Field of Classification Search ..... 482/106–108, 482/110, 55, 126, 129–130, 111; 440/101–103
See application file for complete search history.

(56) References Cited

U.S. PATENT DOCUMENTS 4,075,922 A * 2/1978 Smith ..... 84/402
4,416,451 A * 11/1983 Solloway ..... 482/111
4,480,829 A * 11/1984 Yacoboski ..... 482/111
D279,919 S * 7/1985 Bedgood ..... D21/678
4,623,142 A * 11/1986 MacKechnie ..... 482/111
4,804,177 A * 2/1989 Rosson ..... 482/55
4,819,951 A * 4/1989 Solloway ..... 482/111
4,902,005 A * 2/1990 McNeill ..... 482/93
5,100,148 A * 3/1992 Smith ..... 473/228
D336,101 S * 6/1993 Lewis ..... D17/22
5,531,657 A * 7/1996 Macedo ..... 482/111
5,842,957 A * 12/1998 Wheeler ..... 482/111
5,967,952 A * 10/1999 Bronstein et al. ..... 482/111
7,101,241 B2 * 9/2006 Monroe ..... 441/129
7,128,698 B2 * 10/2006 Shifferaw ..... 482/111
2005/0227821 A1 * 10/2005 Powell et al. ..... 482/55
2008/0058179 A1 * 3/2008 Stout et al. ..... 482/111

* cited by examiner

*Primary Examiner*—Fenn C Mathew

(57) ABSTRACT

An aquatic weight assembly includes a handle and at least one resistance panel assembly having at least one aquatic resistance panel carried by the handle.

7 Claims, 6 Drawing Sheets

AQUATIC RESISTANCE ASSEMBLY

FIELD OF THE INVENTION

The present disclosure relates to exercise devices. More particularly, the present disclosure relates to an aquatic resistance assembly which is suitable for imparting variable low-impact resistance to movements of an exerciser in a water environment.

BACKGROUND OF THE INVENTION

Water exercises are enjoyed by persons all over the world as a way to maintain strength, endurance and flexibility. Water exercises include swimming, water aerobics and resistance training. Because of their low-impact nature, water exercises are suitable for persons of all ages including the elderly.

What is needed is an aquatic resistance assembly which is suitable for imparting variable low-impact resistance to movements of an exerciser in a water environment.

SUMMARY OF THE INVENTION

The present disclosure is generally directed to an aquatic weight assembly. An illustrative embodiment of the aquatic weight assembly includes a handle and at least one resistance panel assembly having at least one aquatic resistance panel carried by the handle.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure which is defined by the claims. Furthermore, there is no intention to be bound by any expressed or implied theory presented in the preceding technical field, background, brief summary or the following detailed description.

Figure 5:
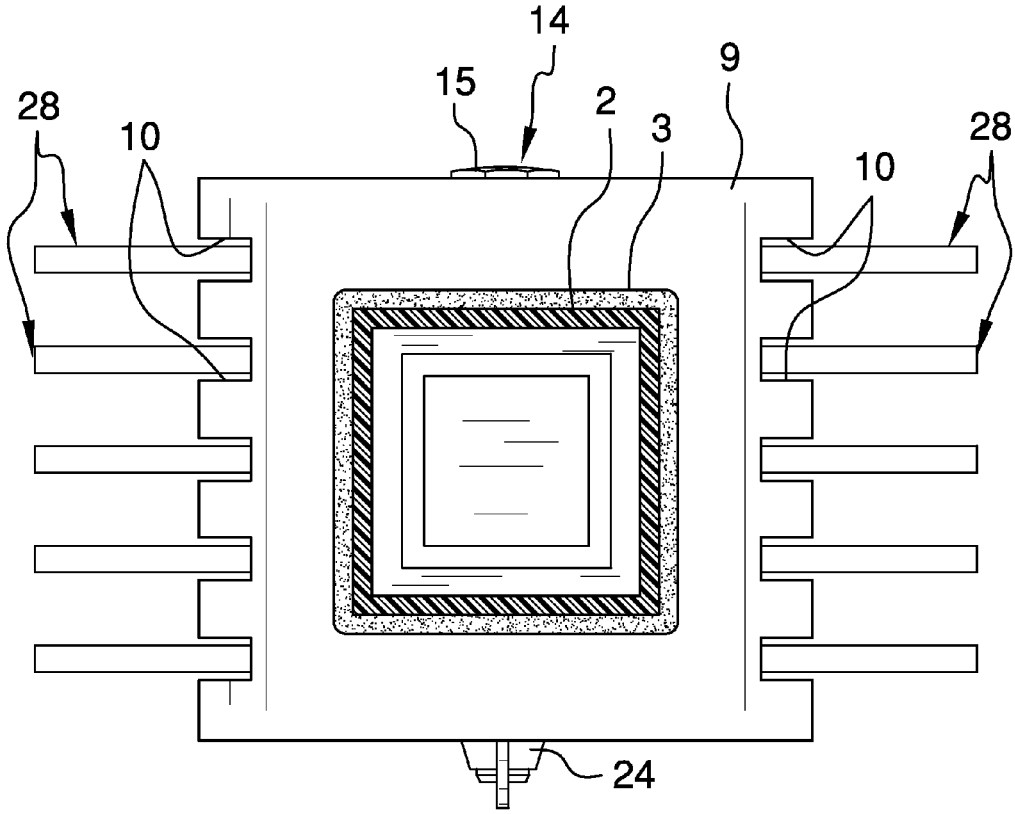
FIG. 5 is a sectional view, taken along section lines 5-5 in FIG. 1, of an illustrative embodiment of the aquatic resistance assembly.

Referring to the drawings, an illustrative embodiment of the aquatic resistance assembly is generally indicated by reference numeral 1. The aquatic resistance assembly 1 includes a handle 2 which may be generally elongated. As shown in FIG. 5, in some embodiments the handle 2 may have a generally rectangular cross-sectional shape. Handle padding 3 may be provided on the handle 2. The handle 2 may have spaced-apart handle ends 4.

A resistance panel assembly 8 may be provided on at least one handle end 4 of the handle 2. In some embodiments, a resistance panel assembly 8 may be provided on each handle end 4 of the handle 2. Each resistance panel assembly 8 may include a panel hub 9 which is attached to the corresponding handle end 4 according to the knowledge of those skilled in the art. Each panel hub 9 may be generally cylindrical.

Figure 3:
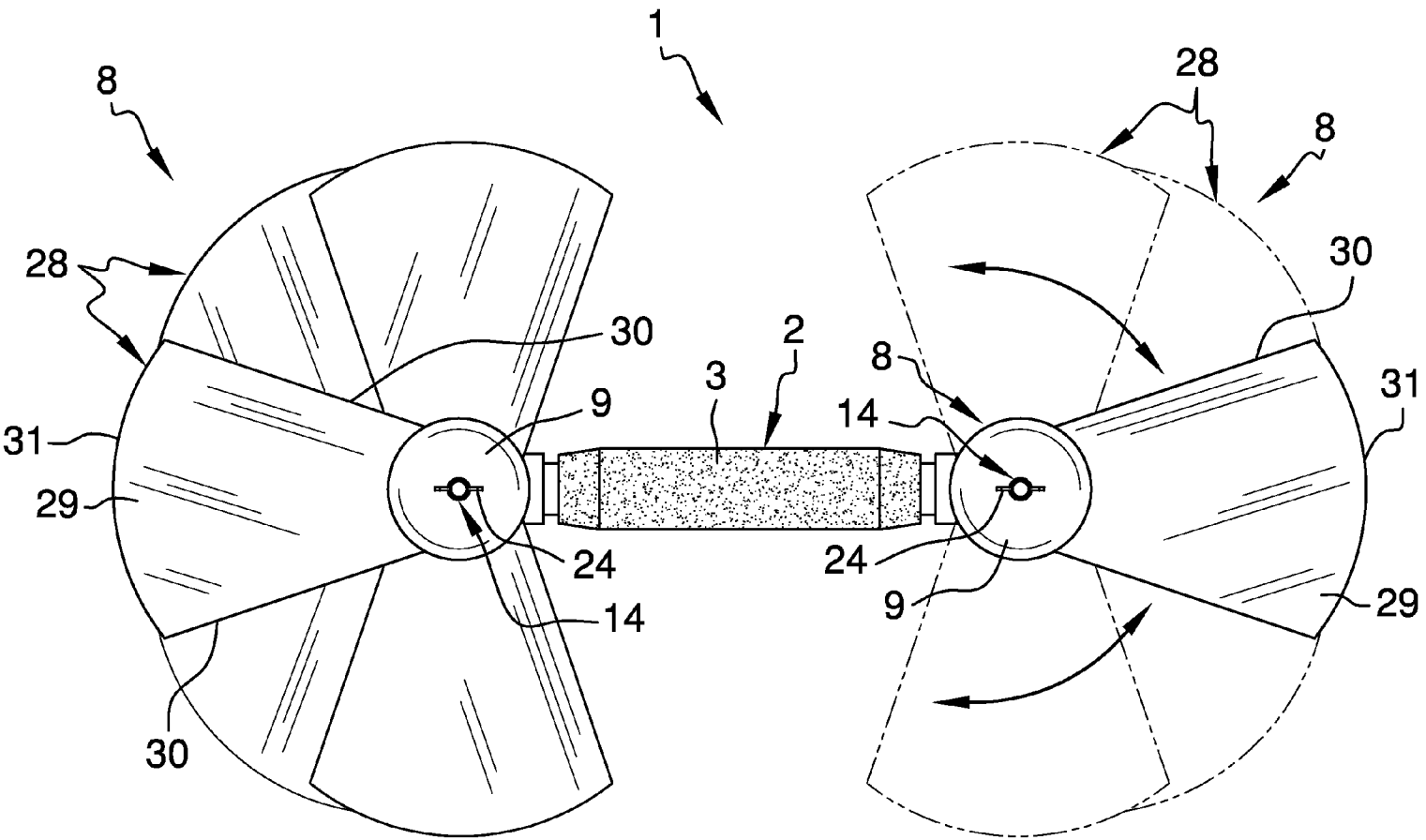
FIG. 3 is a top view of an illustrative embodiment of the aquatic resistance assembly, more particularly illustrating adjustability in a pair of resistance panel assemblies of the aquatic resistance assembly.

At least one aquatic resistance panel 28 may extend from each panel hub 9 of each resistance panel assembly 8. Each aquatic resistance panel 28 may be attached to the panel hub 9 according to the knowledge of those skilled in the art. In some embodiments, at least one panel slot 10 may be provided in each panel hub 9. Each aquatic resistance panel 28 may be secured in each panel slot 10 using a panel bolt 14. In some embodiments, multiple panel slots 10 may be provided in each panel hub 9, as shown. The panel slots 10 may be disposed in generally parallel, spaced-apart relationship with respect to each other. Multiple aquatic resistance panels 28 may extend from the respective panel slots 10. As shown in FIG. 3, the aquatic resistance panels 28 may be capable of pivoting with respect to the panel bolt 14 and sliding in the respective panel slots 10 to facilitate fanning of the aquatic resistance panels 28 with respect to each other for purposes which will be hereinafter described.

Figure 1:
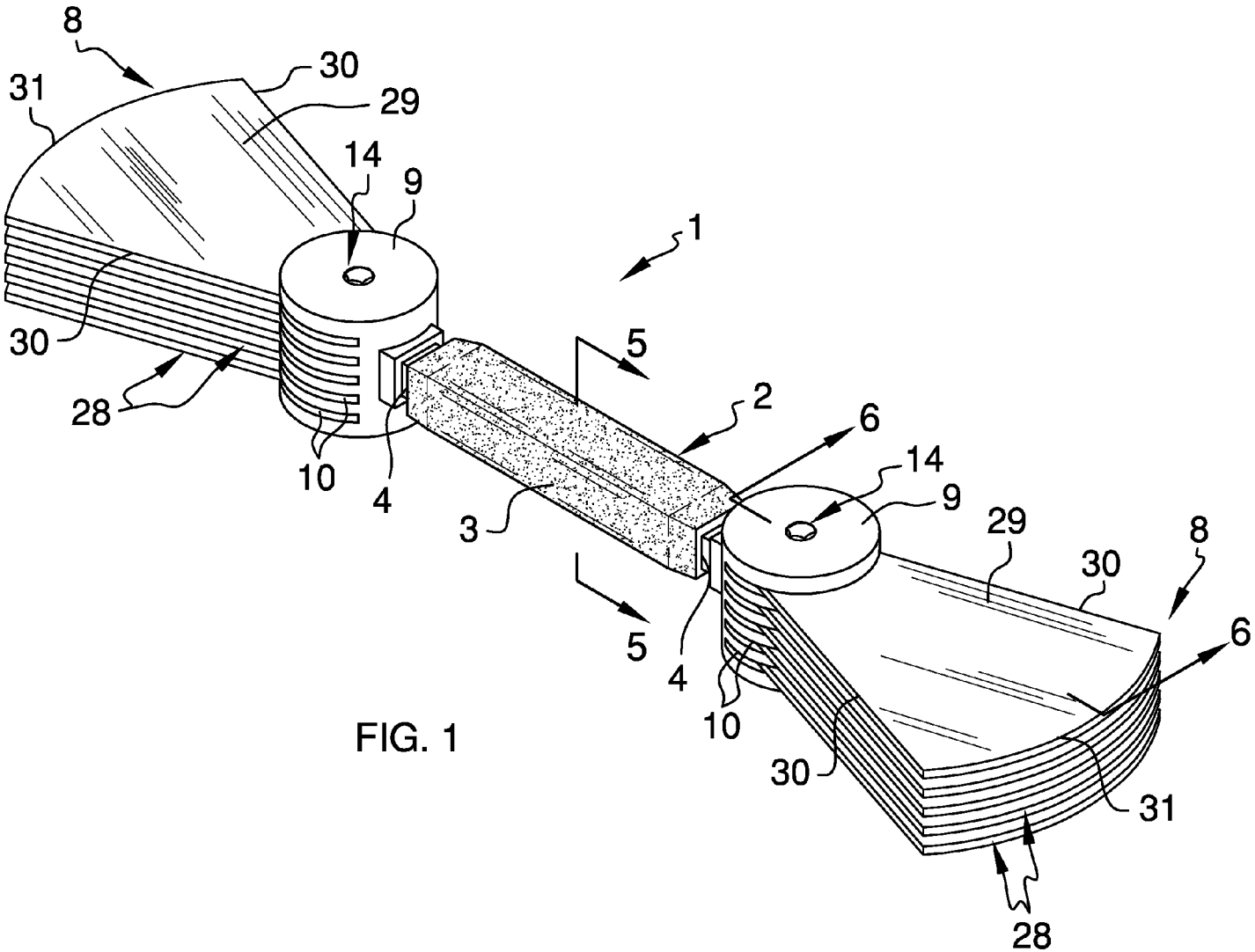
FIG. 1 is a perspective view of an illustrative embodiment of the aquatic resistance assembly.
Figure 2:
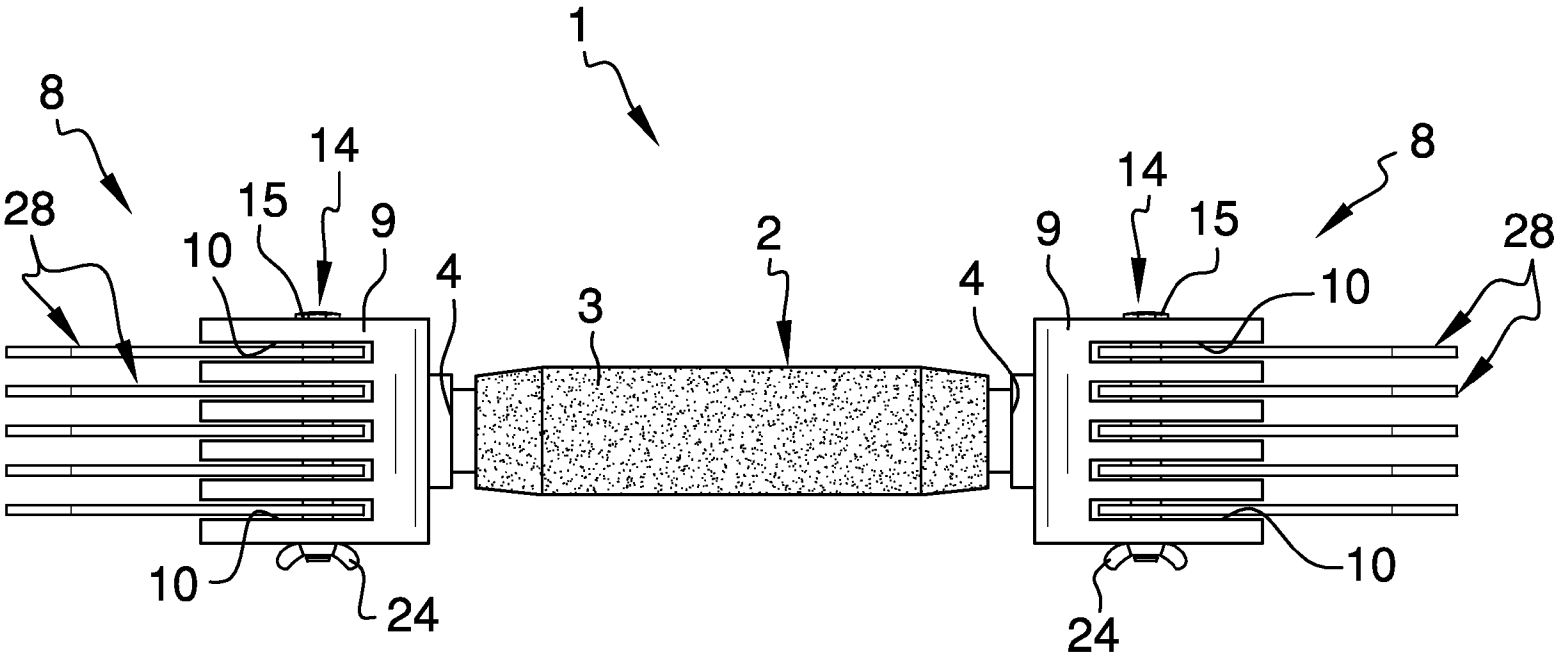
FIG. 2 is a side view of an illustrative embodiment of the aquatic resistance assembly.

As shown in FIG. 1, each aquatic resistance panel may include a panel body 29 which may be a rigid material such as metal or plastic, for example and without limitation. Each panel body 29 may have a generally cone-shaped configuration with a pair of diverging panel side edges 30 and a curved panel outer edge 31 which extends between the panel side edges 30.

Figure 6:
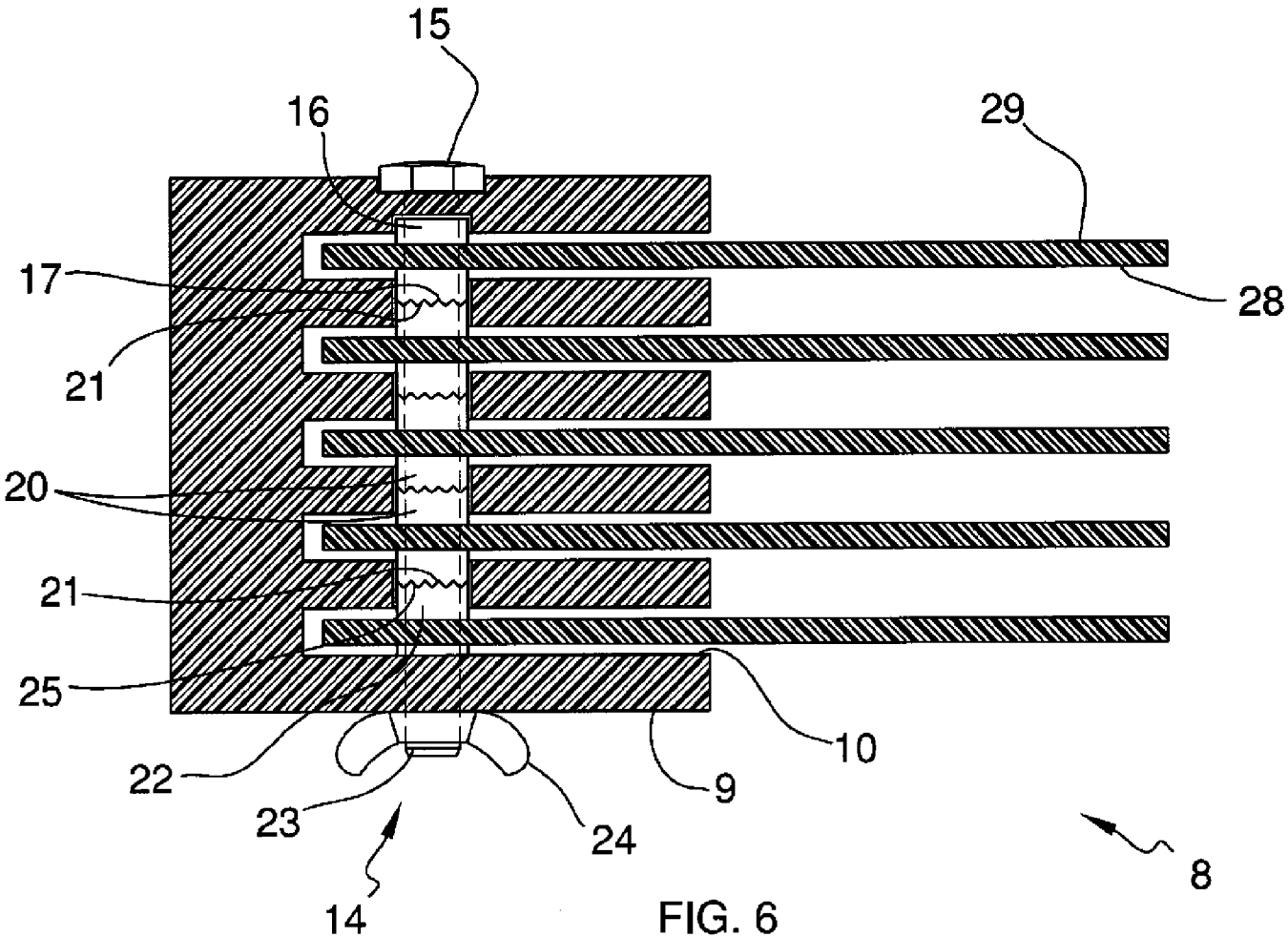
FIG. 6 is a sectional view of a resistance panel assembly of an illustrative embodiment of the aquatic resistance assembly.

As shown in FIG. 6, the panel bolt 14 may include a bolt head 15 and a bolt shaft 16 which extends from the bolt head 15. Multiple intermediate shaft segments 20 may detachably interface with the bolt shaft 16. A terminal shaft segment 22 may detachably interface with the intermediate shaft segments 20. Shaft teeth 17 may be provided on the end of the bolt shaft 16. Intermediate shaft segment teeth 21 may be provided on each end of each intermediate shaft segment 20. Terminal shaft segment teeth 25 may be provided on the end of the terminal shaft segment 22. Accordingly, the shaft teeth 17 on the bolt shaft 16 mesh with the intermediate shaft segment teeth 21 on the proximal-most intermediate shaft segment 20. The intermediate shaft segment teeth 21 on each intermediate shaft segment 20 mesh with the intermediate shaft segment teeth 21 on the adjacent intermediate shaft segment 20. The intermediate shaft segment teeth 21 on the distal-most intermediate shaft segment 20 mesh with the terminal shaft segment teeth 25 on the terminal shaft segment 22. Therefore, as further shown in FIG. 6, each of the bolt shaft 16; the intermediate shaft segments 20; and the terminal shaft segment 22 extends through a bolt opening (not shown) provided in the panel hub 9. The panel bodies of the respective aquatic resistance panels 28 are attached to the bolt shaft 16, the intermediate shaft segments 20 and the terminal shaft segment 22, respectively, of the panel bolt 14 according to the knowledge of those skilled in the art. A wing nut 24 may be threaded on shaft threads 23 provided on the terminal shaft segment 22 and tightened against the panel hub 9 to secure the panel bolt 14 and the aquatic resistance panels 28 in the resistance panel assembly 8. The wing nut 24 can be selectively loosened on the shaft threads 23 to facilitate disengagement of the bolt shaft 16 from the intermediate shaft segments 20, disengagement of the intermediate shaft segments 20 from each other and/or disengagement of the intermediate shaft segments 20 from the terminal shaft segment 20 and rotation of each shaft segment with respect to the adjacent shaft segment or segments in order to facilitate repositioning of the aquatic resistance panels 28 with respect to each other. The shaft segments can then be re-engaged with each other and the wing nut 24 again tightened on the terminal shaft segment 22 to secure the aquatic resistance panels 28 at the new positions with respect to each other.

Figure 4:
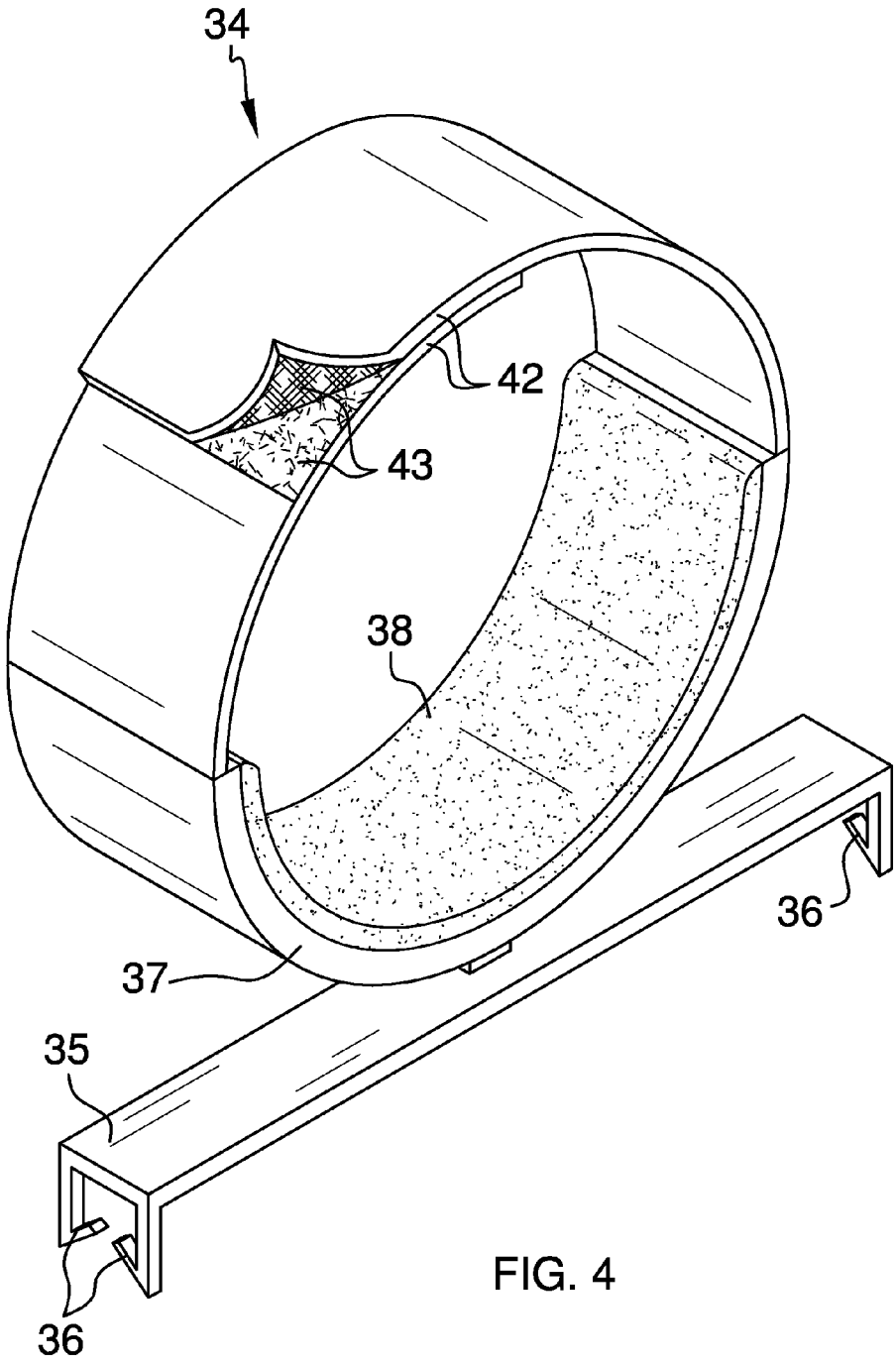
FIG. 4 is a perspective view of an illustrative ankle cuff assembly of an illustrative embodiment of the aquatic resistance assembly.

As shown in FIG. 4, in some embodiments an ankle cuff assembly 34 may be adapted for attachment to the handle 2 of the aquatic weight assembly 1. The ankle cuff assembly 34 may include a frame 35 which may be fitted with attachment prongs 36 or other attachment features to facilitate attachment of the frame 35 to the handle 2 of the aquatic weight assembly 1 according to the knowledge of those skilled in the art. A semicircular cuff 37 may be attached to the frame 35 using welding and/or other suitable attachment mechanism known to those skilled in the art. Cuff padding 38 may be provided on the interior surface of the cuff 37. Cuff straps 42, each of which may be fitted with an attachment mechanism 43 such as hook and loop fasteners, for example and without limitation, may extend from respective ends of the cuff 37. Accordingly, the cuff 37 may be adapted to receive an ankle (not shown) of a user and the cuff straps 42 secured around the ankle for purposes which will be hereinafter described.

In typical use, an exerciser (not shown) grips the handle 2 with one or both hands and pushes, pulls or otherwise moves the aquatic weight assembly 1 in a body of water (not shown) such as a swimming pool, for example and without limitation. As the aquatic weight assembly 1 moves against the water, the water exerts resistance against the aquatic resistance panels 28 of each resistance panel assembly 8. This water resistance imparted to the aquatic weight assembly 1 exercises muscles in the arms, chest or shoulders which actuate the movement. As shown in FIG. 3, the aquatic resistance panels 28 can be selectively fanned out to increase the collective surface area of the aquatic resistance panels 28 and increase the resistance of the aquatic weight assembly 1 in the water by loosening the wing nut 24 on the terminal shaft segment 22, as was heretofore described with respect to FIG. 6. In some applications, the handle 2 of the aquatic weight assembly 1 can be attached to the frame 35 (FIG. 4) of the ankle cuff assembly 34, the cuff 37 of which can be secured to the ankle of the exerciser using the cuff straps 42. The exerciser can then move his or her leg in the water as the water exerts resistance against the aquatic resistance panels 28 to exercise the legs of the exerciser.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. An aquatic weight assembly, comprising:

a handle; and at least one resistance panel assembly having at least one aquatic resistance panel carried by said handle;

said at least one resistance panel assembly comprises a panel hub carried by said handle and a plurality of panel slots provided in said panel hub, and wherein said at least one aquatic resistance panel comprises a plurality of aquatic resistance panels slidably disposed in said plurality of panel slots, respectively;

a panel bolt carried by said panel hub and securing said plurality of aquatic resistance panels to said panel hub; and said panel bolt comprises a bolt head, a bolt shaft extending from said bolt head and a plurality of shaft segments detachably engaging said bolt shaft and each other and wherein said plurality of aquatic resistance panels is carried by said bolt shaft and said plurality of shaft segments, respectively.

2. The aquatic weight assembly of claim 1 wherein said at least one resistance panel assembly comprises a pair of resistance panel assemblies provided at respective ends of said handle.

3. The aquatic weight assembly of claim 1 wherein said at least one aquatic resistance panel comprises a plurality of aquatic resistance panels.

4. The aquatic weight assembly of claim 1 wherein said at least one aquatic resistance panel comprises a panel body having a pair of diverging panel side edges and a curved panel outer edge extending between said panel side edges.

5. The aquatic weight assembly of claim 1 further comprising an ankle cuff assembly having a frame adapted for attachment to said handle, a semicircular cuff carried by said frame and a pair of cuff straps carried by said cuff.

6. An aquatic weight assembly, comprising:

a handle having spaced-apart handle ends;

a pair of panel hubs carried by said handle ends;

a plurality of generally parallel, spaced-apart panel slots provided in each of said pair of panel hubs;

a panel bolt having a bolt head, a bolt shaft extending from said bolt head, a plurality of intermediate shaft segments detachably engaging said bolt shaft and a terminal shaft segment detachably engaging said plurality of intermediate shaft segments and extending through each of said pair of panel hubs;

a resistance panel assembly having a plurality of aquatic resistance panels carried by said bolt shaft, said plurality of intermediate shaft segments and said terminal shaft segment, respectively, of said panel bolt and extending from said plurality of panel slots, respectively; and a wing nut provided on said terminal shaft segment.

7. The aquatic weight assembly of claim 6 further comprising a plurality of teeth provided on each of said bolt shaft, said plurality of intermediate shaft segments and said terminal shaft segment.

* * * * *